US008410402B2

(12) United States Patent
Burton

(10) Patent No.: US 8,410,402 B2
(45) Date of Patent: Apr. 2, 2013

(54) METHOD AND APPARATUS FOR USING LIGHT EMITTING DIODES FOR REMOVING MOISTURE

(75) Inventor: Thomas R. Burton, Germantown, TN (US)

(73) Assignee: Dialight Corporation, Farmingdale, NJ (US)

( * ) Notice: Subject to any disclaimer, the term of this patent is extended or adjusted under 35 U.S.C. 154(b) by 908 days.

(21) Appl. No.: 11/845,985

(22) Filed: Aug. 28, 2007

(65) Prior Publication Data

US 2008/0047943 A1 Feb. 28, 2008

Related U.S. Application Data

(60) Provisional application No. 60/840,548, filed on Aug. 28, 2006.

(51) Int. Cl.
*H05B 3/84* (2006.01)

(52) U.S. Cl. ..... 219/220; 362/92; 362/231

(58) Field of Classification Search ..... 219/201, 219/202, 220, 522, 541, 497; 362/547, 92, 362/218, 230, 294
See application file for complete search history.

(56) References Cited

U.S. PATENT DOCUMENTS

| | | | | |
|---|---|---|---|---|
| 4,867,561 | A * | 9/1989 | Fujii et al. | 356/239.8 |
| 5,318,164 | A * | 6/1994 | Barnes et al. | 194/200 |
| 5,897,802 | A * | 4/1999 | Jones | 219/202 |
| 6,191,541 | B1 * | 2/2001 | Patel et al. | 315/307 |
| 7,211,771 | B1 * | 5/2007 | Smith et al. | 219/502 |
| 8,292,458 | B2 * | 10/2012 | Bertram et al. | 362/231 |
| 2003/0107323 | A1 * | 6/2003 | Stam | 315/82 |
| 2004/0174712 | A1 * | 9/2004 | Yagi | 362/475 |
| 2004/0240219 | A1 * | 12/2004 | Oishi et al. | 362/487 |
| 2006/0121602 | A1 * | 6/2006 | Hoshizaki et al. | 435/288.7 |
| 2011/0304268 | A1 * | 12/2011 | Bertram et al. | 315/46 |

FOREIGN PATENT DOCUMENTS

JP 2006332198 A * 12/2006

* cited by examiner

*Primary Examiner* — Joseph M Pelham
*Assistant Examiner* — Vinod D Patel

(57) ABSTRACT

A method and apparatus for removing moisture from a lighting apparatus is disclosed. In one embodiment of the present invention, the apparatus for removing moisture from a lighting apparatus includes at least one light emitting diode (LED) for outputting visible light and at least one LED for outputting infrared light to remove moisture from the housing.

13 Claims, 2 Drawing Sheets

METHOD AND APPARATUS FOR USING LIGHT EMITTING DIODES FOR REMOVING MOISTURE

CROSS REFERENCE TO RELATED APPLICATIONS

This application claims the benefit of U.S. Provisional Patent Application No. 60/840,548 filed on Aug. 28, 2006, which is herein incorporated by reference.

FIELD OF THE INVENTION

The present invention relates generally to the use of infrared light emitting diodes (LEDs) to remove moisture or condensation and more specifically to a method and apparatus for using LEDs for removing moisture from lighting applications.

BACKGROUND OF THE INVENTION

Presently used lighting applications can have its light path blocked by moisture. For example, during severe weather, the light path may be blocked by a layer of ice or snow. As a result, the light outputted by the lighting application may be difficult to see. Moreover, the moisture may cause the lighting application to malfunction. If the lighting application serves a safety function, such as traffic signal lights or beacon lights, this may create a safety hazard and result in dangerous conditions at times when the light output from the lighting application is critical.

SUMMARY OF THE INVENTION

In one embodiment, the present invention provides an apparatus for removing moisture from a lighting apparatus comprising at least one light emitting diode (LED) for outputting visible light and at least one LED for outputting infrared light to remove moisture from the housing.

In another embodiment, the present invention provides an apparatus for removing moisture from a lighting apparatus comprising at least one means for outputting visible light and at least one means for outputting infrared light to remove moisture from the housing.

In another embodiment, the present invention provides a method for removing moisture from a lighting apparatus comprising providing at least one LED for outputting visible light and providing at least one LED for outputting infrared light to remove moisture from the housing.

BRIEF DESCRIPTION OF THE DRAWINGS

The teaching of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present invention overcomes the problem discussed above by using a combination of at least one LED outputting visible light 104 and at least one LED outputting infrared light 106. In one embodiment, the present invention discloses a method and apparatus to supplement the visible LEDs used in a light apparatus 100, e.g., an LED traffic signal or beacon, with additional infrared LEDs. Using a combination of the visible LEDs to provide the proper color visible light, and the infrared LEDs to provide a radiating heat source to keep the outer surface of the device clear from snow, ice or other types of moisture, creates a device with the energy efficiency of LEDs while having moisture removal ability.

Figure 1:
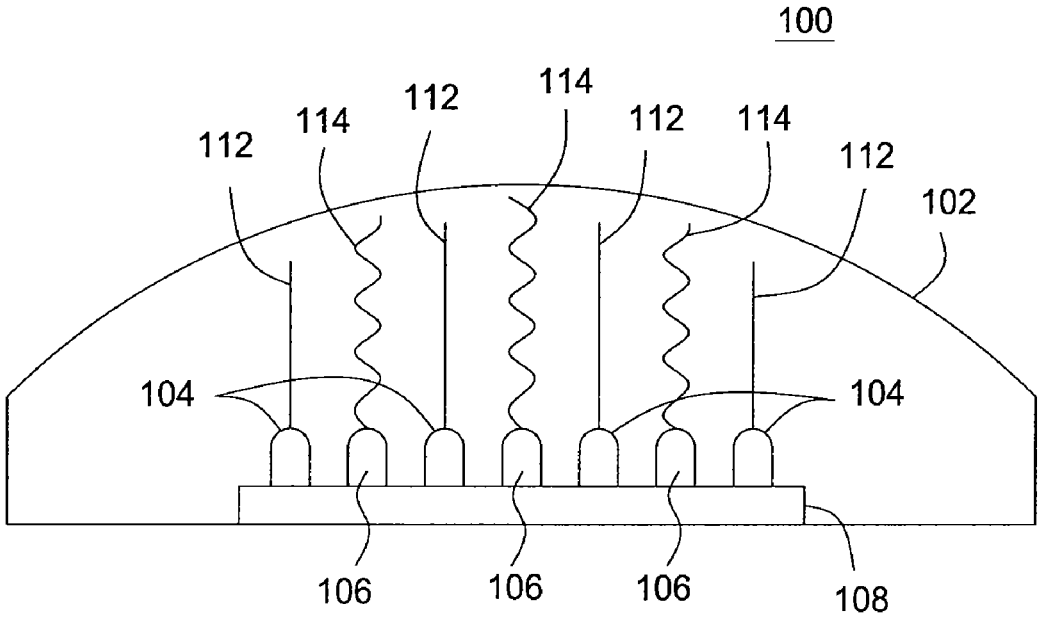
FIG. 1 illustrates a high level block diagram of an illustrative embodiment of the present invention.

FIG. 1 illustrates a high level block diagram of an illustrative embodiment of a lighting apparatus 100 that uses light emitting diodes (LEDs) for removing moisture of the present invention. In one embodiment, the lighting apparatus 100 comprises at least one LED outputting visible light 104, at least one LED outputting infrared light 106 and a circuit board 108 all enclosed in a housing 102 of the lighting apparatus 100. Hereinafter, those skilled in the art will recognize that at least one LED outputting visible light 104 and at least one LED outputting infrared light 106 may interchangeably represent a single LED or a plurality of LEDs.

The at least one LED for outputting visible light 104 may comprise an LED made of any type of material for creating light within the visible light spectrum. For example, the visible light spectrum may be from approximately 400 nanometers (nm)-700 nm. The at least one LED for outputting visible light 104 may be constructed from in-organic materials such as, for example, aluminum gallium phosphide (AlGaP), aluminum gallium nitride (AlGaN), indium gallium nitride (InGaN) or organic materials such as, for example, carbon based compounds. The visible light outputted by the at least one LED for outputting visible light 104 is illustrated by lines 112.

The at least one LED for outputting infrared light 106 may comprise an LED made of any type of material for creating light within the infrared spectrum. For example, the infrared light spectrum may be greater than approximately 750 nm. The at least one LED for outputting infrared light 106 may be constructed from in-organic materials such as, for example, aluminum gallium arsenide (AlGaAs).

The at least one LED for outputting infrared light 106 may emit radiant heat. The radiant heat is illustrated in FIG. 1 by lines 114. The radiant heat 114 may be used to keep the housing 102 of the lighting apparatus 100 clear from snow, ice or other types of moisture. The minimum number of the at least one LED for outputting infrared light 106 required in said lighting apparatus 100 may be a function of an amount of heat needed to remove moisture from said lighting apparatus 100. For example, the number of the at least one LED for outputting infrared light 106 may be directly proportional to the amount of heat needed to remove moisture from said lighting apparatus 100.

The at least one LED for outputting visible light 104 and the at least one LED for outputting infrared light 106 may be coupled to the circuit board 108. The at least one LED for outputting visible light 104 and the at least one LED for outputting infrared light 106 may be arranged on the circuit board 108 in any manner. For example, the at least one LED for outputting visible light 104 and the at least one LED for outputting infrared light 106 may be arranged such that the at least one LED for outputting visible light 104 and the at least one LED for outputting infrared light 106 are placed next to one another in an alternating fashion. In another example, the at least one LED for outputting visible light 104 and the at least one LED for outputting infrared light 106 may be placed in alternating rows of the at least one LED for outputting visible light 104 and the at least one LED for outputting infrared light 106. Yet in another example, there may be adjacent banks of the at least one LED for outputting visible light 104 and the at least one LED for outputting infrared light 106.

Figure 2:
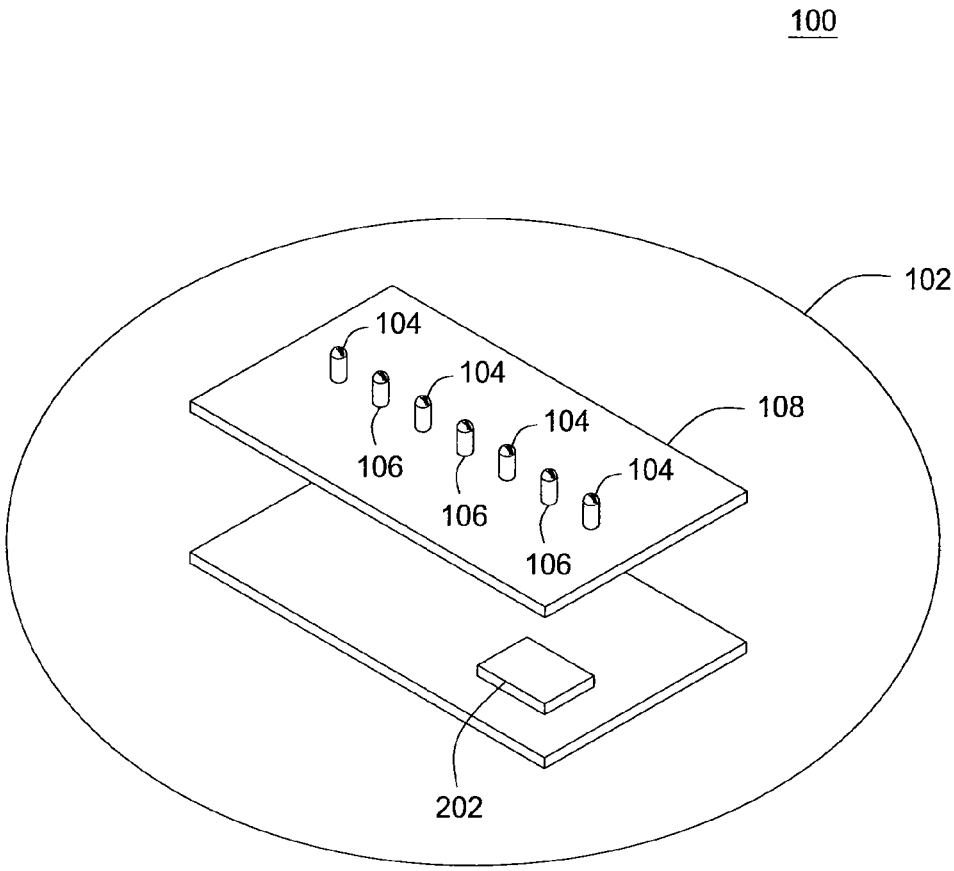
FIG. 2 illustrates an exploded view of an illustrative embodiment of the present invention.

FIG. 2 illustrates an exploded view of an illustrative embodiment of the lighting apparatus 100. FIG. 2 illustrates the at least one LED for outputting visible light 104 and the at least one LED for outputting infrared light 106 coupled to the circuit board 108.

In one embodiment of the present invention, the housing 102 may contain a moisture sensor 202. The moisture sensor 202 may be wired to work in conjunction with the at least one LED for outputting infrared light 106. For example, when the moisture sensor 202 detects moisture on the housing 102, the moisture sensor 202 may trigger the at least one LED for outputting infrared light 106 to turn on. As a result, the at least one LED for outputting infrared light 106 may emit radiant heat to remove the moisture from the housing 102. The moisture sensor 202 helps to conserve energy such that the at least one LED for outputting infrared light 106 may be turned on only when necessary. Otherwise, the at least one LED for outputting infrared light 106 may unnecessarily remain on even when there is no moisture on the housing 102.

While various embodiments have been described above, it should be understood that they have been presented by way of example only, and not limitation. Thus, the breadth and scope of a preferred embodiment should not be limited by any of the above-described illustrative embodiments, but should be defined only in accordance with the following claims and their equivalents.

What is claimed is:

1. An apparatus for removing moisture from a housing of a lighting apparatus, comprising:

at least one light emitting diode (LED) for outputting visible light;

at least one LED for outputting infrared light to remove moisture from said housing, wherein a number of the at least one LED for outputting infrared light is a function of an amount of heat needed to remove moisture from an outer surface of the housing of the lighting apparatus; and a moisture sensor, wherein said moisture sensor triggers said at least one LED for outputting infrared light to turn on when said moisture sensor detects moisture on said housing.

2. The apparatus of claim 1, wherein said at least one LED for outputting visible light produces light wavelengths between 400 nanometers (nm) -700 nm.

3. The apparatus of claim 1, wherein said at least one LED for outputting infrared light produces light wavelengths greater than or equal to 750 nanometers.

4. The apparatus of claim 1, wherein said at least one LED for outputting infrared light produces radiant heat.

5. The apparatus of claim 1, wherein said LED for outputting infrared light is constructed from aluminum gallium arsenide.

6. The apparatus of claim 1, wherein said lighting apparatus comprises a traffic signal light.

7. The apparatus of claim 1, wherein said lighting apparatus comprises a beacon signal.

8. An apparatus for removing moisture from a housing of a lighting apparatus, comprising:

at least one means for outputting visible light;

at least one means for outputting infrared light to remove moisture from said housing, wherein a number of the at least one means for outputting infrared light is a function of an amount of heat needed to remove moisture from an outer surface of the housing of the lighting apparatus; and a means for sensing moisture, wherein said means for sensing moisture triggers said means for outputting infrared light to turn on when said means for sensing moisture detects moisture on said housing.

9. The apparatus of claim 8, wherein said means for outputting visible light produces light wavelengths between 400 nanometers (nm) - 700 nm.

10. The apparatus of claim 8, wherein said means for outputting infrared light produces light wavelengths greater than or equal to 750 nanometers.

11. The apparatus of claim 8, wherein said at least one LED for outputting infrared light produces radiant heat.

12. The apparatus of claim 8, wherein said means for outputting infrared light is constructed from aluminum gallium arsenide.

13. A method for removing moisture from a housing of a lighting apparatus, comprising:

providing at least one light emitting diode (LED) for outputting visible light;

providing at least one LED for outputting infrared light to remove moisture from said housing, wherein a number of the at least one LED for outputting infrared light that is provided is a function of an amount of heat needed to remove moisture from an outer surface of the housing of the lighting apparatus;

sensing moisture on said housing; and turning on said at least one LED for outputting infrared light to remove moisture from said housing in response to said sensing said moisture on said housing.

* * * * *